US005412910A

United States Patent [19]

Woodson et al.

[11] Patent Number: 5,412,910

[45] Date of Patent: May 9, 1995

[54] WET ABRASIVE BLASTING METHOD AND APPARATUS

[75] Inventors: Jerry P. Woodson; Lawrence M. Camarota, both of Houston, Tex.

[73] Assignee: Whitemetal, Inc., Houston, Tex.

[21] Appl. No.: 31,693

[22] Filed: Mar. 15, 1993

Related U.S. Application Data

[63] Continuation-in-part of Ser. No. 893,456, Jun. 4, 1992, Pat. No. 5,239,788, which is a continuation of Ser. No. 668,747, Mar. 13, 1991, Pat. No. 5,123,206, which is a continuation of Ser. No. 415,033, Sep. 29, 1989, abandoned, which is a continuation of Ser. No. 128,589, Dec. 4, 1987, Pat. No. 4,878,320.

[51] Int. Cl.[6] ..... B24C 1/00

[52] U.S. Cl. ..... 451/38; 451/39; 451/468; 451/471

[58] Field of Search ..... 51/319, 320, 321, 410, 51/427, 436, 437, 438

[56] References Cited

U.S. PATENT DOCUMENTS

| | | | |
|---|---|---|---|
| 2,726,137 | 12/1955 | Davis, Jr. | 406/122 |
| 2,729,917 | 1/1956 | Gregory | 57/427 |
| 2,913,281 | 11/1959 | Le Blanc | 406/146 |
| 3,626,841 | 7/1969 | Schachter | 57/436 |
| 4,048,757 | 9/1977 | Kobus et al. | 57/411 |
| 4,075,789 | 2/1978 | Dremann | 57/436 |
| 4,420,957 | 12/1983 | Weber | 57/410 |
| 4,494,932 | 1/1985 | Rzewinski | 57/436 |
| 4,689,923 | 9/1987 | Goudeaux et al. | 57/410 |
| 4,878,320 | 11/1989 | Woodson | 51/320 |

*Primary Examiner*—Maurina T. Rachuba

*Attorney, Agent, or Firm*—Bush, Moseley, Riddle & Jackson

[57] ABSTRACT

An abrasive feed system is shown in FIG. 3 in which pressurized air from air compressor (10A) is cooled and dried by heat exchanger (123A), water separator (125A) and chemical air dryer (127A) for delivery to a differential pressure regulator (104A) and an abrasive container (100A) for sodium bicarbonate or other hydroscopic or water soluble or moisture sensitive particles. Differential pressure regulator (104A) senses the fluid pressure in transport line (117A) though a sensing line (130A) and automatically maintains the fluid pressure in air supply line (102A) to the abrasive container (100A) at a predetermined set pressure differential between line (102A) and (117A) so that the pressure in line (102A) is maintained at a predetermined pressure level above the pressure in transport line (117A).

18 Claims, 2 Drawing Sheets

WET ABRASIVE BLASTING METHOD AND APPARATUS

CROSS REFERENCE

This application is a continuation-in-part of application Ser. No. 07/893,456 filed Jun. 4, 1992, now U.S. Pat. No. 5,239,788, which is a continuation of application Ser. No. 07/668,747 filed Mar. 13, 1991, now U.S. Pat. No. 5,123,206, which is a continuation of application Ser. No. 415,033 filed Sep. 29, 1989, abandoned, which is a continuation of application Ser. No. 07/128,589, filed Dec. 4,1987, now U.S. Pat. No. 4,878,320.

BACKGROUND OF THE INVENTION

1. Field of the Invention

This invention relates generally to a liquid-propelled, abrasive blast cleaning system, and particularly to a selective abrasion system for removing a covering or coating from a material to be cleaned without damaging an underlying substrate thereof.

2. Description of Prior Art

To remove the paint from an aircraft, a fiberglass boat or the like, so that it can be repainted as needed, a selective abrasion system is both desirable and necessary. Such system must have the capability of removing a paint coating without damaging the underlying metal or other substrate. The removal of paint by conventional sand blasting can result in too much anchor pattern (surface roughness) in the aluminum sheet. Blast particles such as crushed walnut shells and plastic buttons have been tried, and although brittle paint was removed, the particles are so resilient that they will bounce off of a flexible urethane coating. Agricultural products such as rice hulls and corn cob grit also have been tried, however these particles are so small and sharp that the aluminum is cut too deep. Problems in obtaining sufficient flow of these types of abrasive particles are almost insurmountable. Some agricultural abrasives contain oil so as to present a fire or explosive hazard, and leave an oil film that can prevent good paint adhesion. Thus the need for an effective selective abrasion system has persisted, particularly in view of the fact that stripping and repainting of certain large commercial aircraft can cost several hundred thousand dollars. Of course any paint removal scheme that also removes a significant amount of the metal must be avoided for safety reasons.

Applicants have therefore sought an abrasive compatible with a wet blast stripping system that is sharp, dense and hard enough to cut through and remove paint without damaging the underlying aluminum, fiberglass or a carbon fiber laminate. Their investigations have revealed that an abrasive particle may be used that has a scratch hardness characteristic not substantially greater, and preferably slightly less than the scratch hardness of aluminum, which is about 3 on the Mohs scale. It has been discovered that sodium bicarbonate is an extraordinarily good abrasive material for the foregoing application. Sodium bicarbonate has a Mohs hardness of about 3, a density similar to that of conventional blast particles such as sand, and good mass. This material is relatively inexpensive, readily available in large quantities, and in various particle sizes.

Tests of a wet blast cleaning system demonstrated that water pressures in the range of 1500–5000 psi with air pressure of 60 psi, gave satisfactory performance.

However, the flow of sodium bicarbonate (and other Hydroscopic and/or water soluble) particles from the abrasive hopper was somewhat irregular and inconsistent, so that the process could be considered to be impractical except in a laboratory test environment. Tests indicate that higher water pressure may further enhance productivity. Thus applicants sought and found a solution to this problem, which is the subject of the present invention.

Identification of Objects of the Invention

The general object of the present invention is to provide a new and improved abrasive feed system in a wet or dry blast cleaning process using a hydroscopic and/or water soluble abrasive such as sodium bicarbonate.

Another object of this invention is to provide such an abrasive feed system in which pressurized air is utilized for the transport of the abrasive to a discharge nozzle and pressurized dry air is utilized as the dry gas for pressurizing an abrasive container at a pressure level greater than the pressure level in the transport line to the nozzle.

A further object is to provide such an abrasive feed system in which the pressure level of the pressurized abrasive container is maintained automatically at a predetermined pressure level above the pressure level (constant differential pressure) of the transport line to the nozzle to provide a smooth flow of abrasive material to the transport line.

SUMMARY

These and other objects are attained in accordance with the concepts of the present invention through the provision of a wet blast system comprising a nozzle for applying a high pressure stream of water and propelled sodium bicarbonate particles to remove a coating of paint from a surface such as aluminum sheet, a pump and a compressor for providing respective pressurized supplies of water and air to the nozzle, and a hopper for providing a pressurized supply of sodium bicarbonate particles to the nozzle where such particles are propelled onto the surface to be cleaned. In order to provide a regulated flow of sodium bicarbonate particles from the hopper, a source of dry gas such as air which has been dried or nitrogen is supplied to the hopper at a regulated pressure such that said particles enter the air line leading to the nozzle at a pressure that exceeds the pressure of the supply of air to the nozzle. In this manner, compressed air which may contain moisture is prevented from entering the hopper, and a regular flow of a controlled amount of abrasive particles is fed into the air line leading to the nozzle. This system allows the use of an abrasive such as sodium bicarbonate, as well as a variety of other water soluble abrasive particles that heretofore could not be used due to the moisture content of the supply of compressed air that was used to pressurize the hopper. As a result, a selective abrasion action can be achieved in a highly efficient and effective manner.

Another aspect of the invention relates to a method of cleaning by applying a stream of dry water soluble abrasive particles, such as sodium bicarbonate particles, entrained in air, as the abrasive agent to a cavity of a blast nozzle to which water under pressure is also applied. Such method includes the step of directing the output of the nozzle toward a surface to be cleaned.

An embodiment shown in FIG. 3 utilizes pressurized dried air for the gas supply line to the abrasive container or hopper for pressurizing the abrasive container at a pressure level greater than the pressure in the transport line to the nozzle. A differential pressure regulator in the gas supply line senses the air pressure in the transport line and automatically maintains the pressure in the air supply line to the hopper at a predetermined amount above the pressure in the transport line. The predetermined fluid pressure differential may be set for automatically maintaining the pressure level in the air supply line to the container, for example, at 3 psi, above the pressure level in the transport line. The pressurized dry air for the air supply line to the container is cooled and dried upstream of the differential pressure regulator.

BRIEF DESCRIPTION OF THE DRAWINGS

The present invention has other objects, features and advantages which will become more clearly apparent in connection with the following detailed description of preferred embodiments, taken in conjunction with the appended drawings, in which.

DETAILED DESCRIPTION OF A PREFERRED EMBODIMENT

Figure 1:
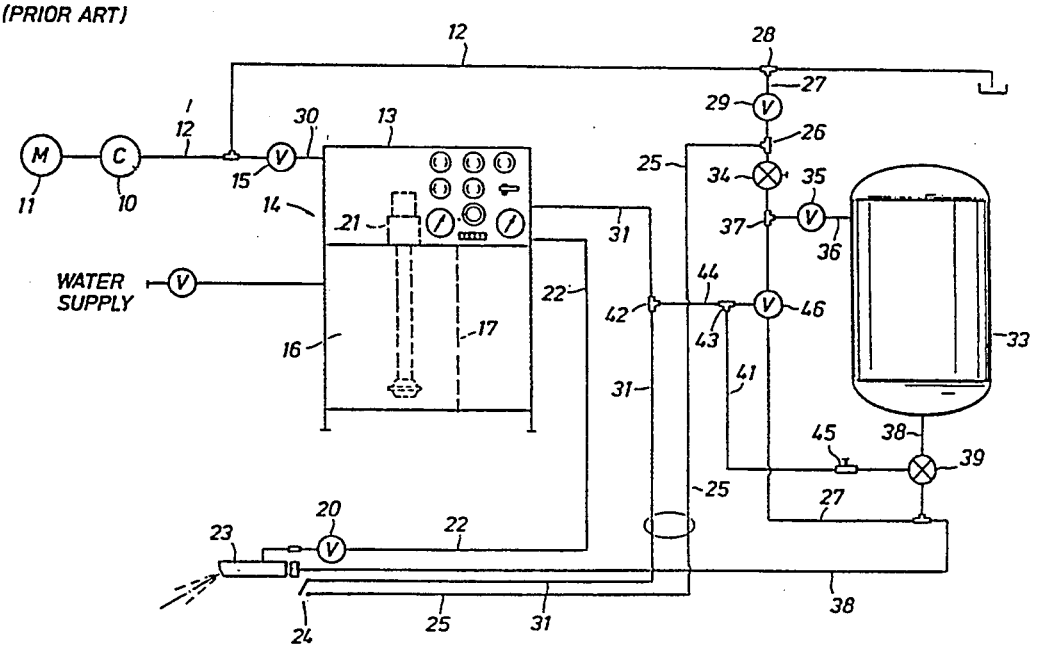
FIG.1 (PRIOR ART)
FIG. 1 is a schematic of a wet blast cleaning system of the prior art that employs sand particles as the abrasive medium.

Referring initially to FIG. 1, a prior liquid propelled abrasive cleaning system of the type shown in U.S. Pat. No. 4,821,467 and assigned to the assignee of this invention, is illustrated. The system includes an air compressor 10 which is driven by a suitable motor 11 to provide a supply of air under pressure to a line 12, preferably in a volume range of from 30–90 cfm to operate an air driven water pump, plus the approximately 180 cfm required for operation of a blast nozzle. Pressurized air is fed from the line 12 to a control station or cabinet 14 through a branch line 30 and through an air shut-off valve 15. A supply of water is fed to the lower section 16 of the station 14, which comprises a storage tank that can have separate compartments for water and an inhibitor. A pneumatically operable pump 21 (shown in phantom lines in FIG. 1) is housed in control station 14, whereby water which may contain a controlled amount of rust inhibitor is fed under high pressure to a flexible output hose 22 that communicates with the inlet of a blast nozzle 23. The hose 22 can be relatively long, for example 250 feet, to enable the operator to conduct operations a substantial distance away from the control station 14. A normally closed "dead-man" control valve 24 is mounted adjacent to the nozzle member 23 and functions to prevent operation of the nozzle unless the control valve 24 is being held open by the operator by depression of a spring-loaded actuator handle. In this manner, all flow of high pressure water, air and abrasive particles to the nozzle member 23 is automatically shut off when the operator releases the handle, or if the nozzle member is inadvertently dropped. The inlet of the dead-man valve 24 is connected by a flexible line 25 to a tee 26 in a line 27 that communicates with main air supply line 12 at tee 28. An air shut-off valve 29 is positioned in the line 27 between the tees 28 and 26. The outlet of the dead-man control valve 24 is connected by another flexible line 31 to an appropriate fitting on the side of the upper section 13 of the control station 14, whereby an air pressure signal is given to the control station 14 when the dead-man valve 24 is actuated.

The nozzle member 23, which need not be shown in detail, includes a tubular body having a propulsion chamber, an inlet for abrasive particles, an inlet for water, and an outlet for a spray blast of water and propelled abrasive particles. The dead-man valve 24 includes a body that is mounted to the hose 38 in a suitable manner, the body having an inlet for the line 25 and an outlet for the line 31. A spring-loaded handle is pivoted to the body, and, when depressed by the operator, functions to open a valve element within the body to communicate the line 25 with the line 31. When the handle is released, the valve automatically closes to prevent communication of the line 25 with the line 31. A shut-off valve 20 connects the line 22 to the water inlet of the nozzle assembly 23.

Referring still to FIG. 1, a supply of abrasive particles, such as #3 sand, is contained in a hopper or "pot" 33, sized to hold a suitable amount of abrasive, for example 1000 pounds. Air under pressure from the line 12 passes through a regulator valve 34, a shut-off valve 35 in a branch line 36 from tee 37 in line 27, and into the tank 33 through a suitable fitting, so that the tank 33 is under pressure. A sand feed line 38 leads from the bottom of the tank 33 to a tee connecting the air line 27 to a transport line 38 that goes to the sand inlet of the nozzle member 23. A pilot-operated sand metering and shut-off valve 39 is located in the line 38 adjacent the pot 3. The valve 39 is a normally closed device that is opened in response to air pressure in line 41, which is connected to the air signal line 31 by tees 42 and 43 and a branch line 44. A three-way valve 45 in the line 41 includes a bleed port to enable air pressure to be manually bled off when desired. The line 27 coming from the supply line 12 continues to a normally closed air valve 46 having a pneumatic operator connected to the line 44. Thus the valve 46 is opened only when there is an air pressure signal in line 31 due to opening of the dead-man control valve 24, so that a metered mixture of sand particles and air is supplied to the line 38 only when the nozzle member 23 is in operation.

The internal and external components of the station 14 are disclosed in detail in the above-mentioned U.S. Pat. No. 4,821,467 and need be described in only a general way herein. Suitable indicators, gauges, a pump stroke counter and a water valve actuator handle are used to monitor the operation of the unit. The system shown in FIG. 1 provides outstanding cleaning action where an abrasive such as sand particles can be used. In order to be able to use a water soluble abrasive such as sodium bicarbonate particles in accordance with the present invention, a structure such as shown in FIG. 2 may be used.

Figure 2:
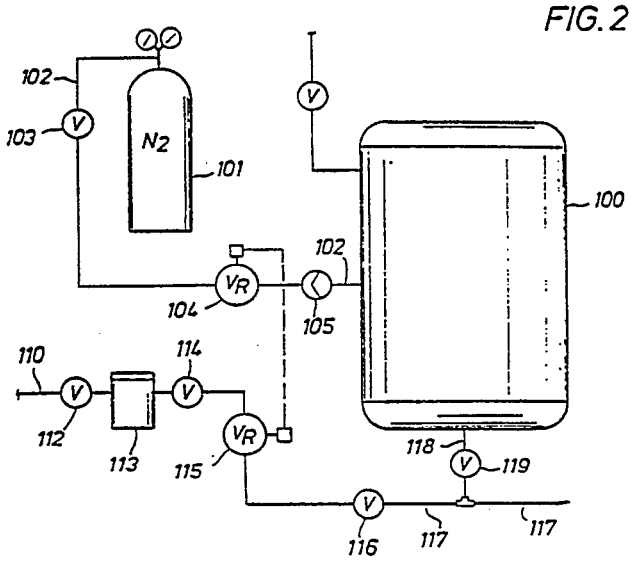
FIG. 2 is a schematic drawing of an embodiment of a pressurized hopper, valve and flow line system which allows use of sodium bicarbonate as an abrasive agent for selective removal of paint from an underlying substrate.

Referring to FIG. 2, the hopper or "pot" 100, which contains a supply of sodium bicarbonate or other moisture sensitive abrasive such as potassium bicarbonate or corn cob grit, is pressurized by a source of dry gas such as nitrogen contained by a bottle 101. The nitrogen is fed via a line 102, a shut-off valve 103, a regulator valve 104, and a check valve 105 to the interior of the hopper 100. Compressed air in line 110 passes through a high volume pressure regulating valve 112 to a dryer or moisture separator 113, after which it is fed via a shut-off valve 114 to a regulator valve 115 and an automatic shut-off valve 116 to a line 117 that passes underneath the bottom of the hopper 100. A flow of abrasive particles under pressure comes down through feed line 118 and a metering valve 119 to a tee connection in the line 117, after which the combined flow of abrasive particles, nitrogen and compressed air is transported to the abrasive particle inlet of the nozzle assembly 23 (FIG. 1).

Figure 3:
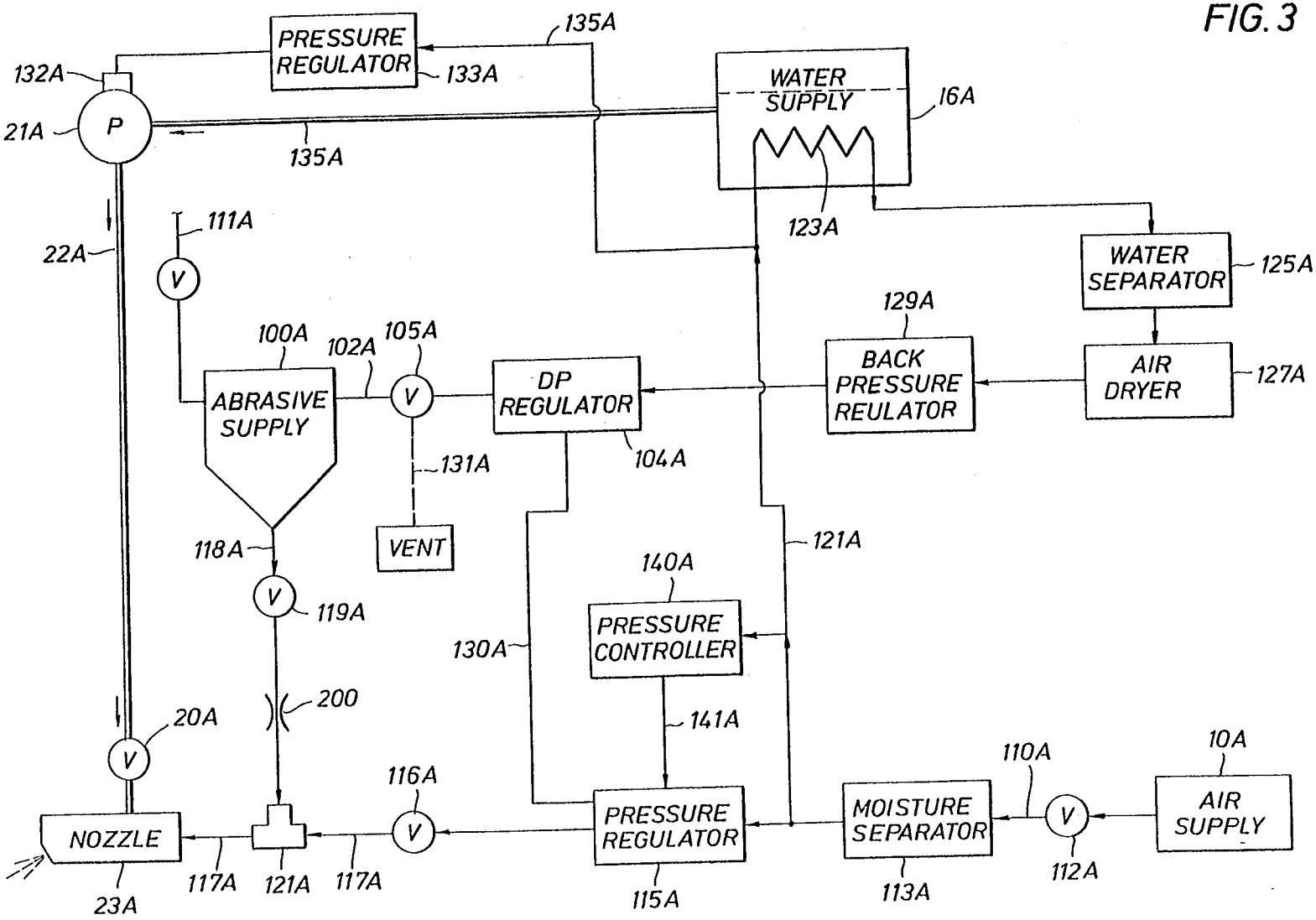
FIG. 3 is a schematic drawing of another embodiment of the present invention in which the pressure differential between the hopper and the transport line is automatically maintained at a predetermined level.

To prevent air in the line 117 from coming into the hopper 100, the regulator valves 104 and 115 preferably are coupled together so that the internal pressure in the hopper, which contains sodium bicarbonate particles, is always greater than the pressure in the blast line 117, such as, for example, the embodiment illustrated hereafter in FIG. 3. Functionally separate regulating valves can be used provided they each have a high sensitivity. The magnitude of positive pressure differential can be used to very precisely control the weight per unit time of sodium bicarbonate that is used in the stripping of paint or other hard or soft films such as carbon and residue from jet engine parts, whereby the present invention provides a very effective metering and feed system for abrasive particles depending upon operational requirements.

Operation

As an example of operation of the present invention, suppose that compressed air in the blast line 117 has a pressure of 100 psi and a flow rate of 200 cfm and the pressure of the nitrogen gas in the line 102 is regulated so that pressure in the hopper 100 is maintained at 102 psi. The positive pressure differential of 2 psi provides a controlled feed of abrasive particles into the line 117 leading to the nozzle assembly 23. With the embodiment shown in FIG. 2, some abrasive flow can be achieved due to gravity when the hopper and transport line pressure are equal. The amount of abrasive particles can be very precisely controlled by controlling the magnitude of the pressure differential between the transport line pressure and the hopper pressure, and can be set, for example, at 10 lbs. per minute, or 600 lbs. per hour. Since no moisture is present in the nitrogen gas to cause the hydroscopic particles to agglomerate, the flow of sodium bicarbonate abrasive into the line 117 is very uniform to yield optimum paint stripping results.

Automatic Regulation of Pressure Differential

Referring now to FIG. 3, an alternative embodiment of the present invention is shown in which dry air (that is, air which has been dried) is used as the dry gas for pressurizing the abrasive container or hopper at a pressure level greater than the pressure level in the transport line to the nozzle. Fluid pressure control means in the pressurized dry air supply line to the abrasive container automatically maintains the fluid pressure in the supply line at a predetermined pressure above the pressure of the transport line to the nozzle.

As shown in FIG. 3, an air source or supply comprising an air compressor 10A communicates with a compressed air line 110A and control valve 112A to supply pressurized air to main transport line 117A extending to nozzle 23A. Air from air compressor 10A is at a pressure of around 125 psi, for example, and a volume of 425 cfm (cubic feet per minute). Nozzle 23A has an inlet for air and entrained abrasive particles from transport line 117A and a separate inlet for high pressure water at a pressure of 3000 psi for example. The mixture of water, air, and entrained abrasive particles is discharged from a propulsion chamber in nozzle 23A against a surface to be cleaned as in the embodiment shown in FIG. 1. A preferred propulsion chamber is described in U.S. Pat. No. 4,817,342, assigned to the assignee of this invention. Such patent is incorporated herein.

High pressure water is supplied from a water supply such as a water reservoir or tank 16A or even a hose by a pneumatically operated (or electric or gasoline) high pressure pump 21A via water supply line 22A to the water inlet for nozzle 23A. A control valve 20A in water supply line 22A controls the supply of water to nozzle 23A. Pump 21A may be pneumatically driven from a pneumatic drive motor 132A as in the embodiment of FIG. 1.

Manual control valve 112A is an on-off valve to control air flow to line 110A from air compressor 10A. A moisture separator 113A adjacent valve 112A separates and removes condensed water, but not all moisture, from the air. A fluid pressure regulator 115A controls the pressure in transport line 117A from regulator 115A to nozzle 23A beneath an abrasive container or hopper 100A containing a water soluble abrasive material, such as sodium bicarbonate. An automatic shut-off valve 116A controls the flow of air from pressure regulator 115A. Abrasive particles, such as bicarbonate of soda particles (or even sand) are supplied to abrasive container 100A from a suitable source through abrasive supply line 111A or simply an opening in the top of the container 100A. Abrasive from container 100A is provided with an abrasive feed line 118A, a shut off valve 119A, and a fixed diameter orifice 200 for feeding or metering abrasive particles in the air stream of transport line 117A. The orifice 200 is removable so that different diameters can be installed to satisfy various operating requirements. A mixing tee 121A effects entrainment of the abrasive particles in the air stream for delivery to nozzle 23A.

To provide dry air to hopper 100A at a pressure above the pressure in transport line 117A, a branch line 121A extends from air line 110A between pressure regulator 115A and moisture separator 113A to a heat exchanger or cooler 123A submerged in water within water reservoir 16A for cooling the pressurized air from air compressor 10A. An air cooler after cooler 123A could also be used. The cooled air, about 20 CFM @ 125 psi, then passes to water separator 125A and to a chemical air dryer 127A.

Chemical dryer 127A utilizes chemical briquettes for absorbing moisture in the air flow therethrough. The chemical briquettes in dryer 127A comprise a deliquescent material, such as calcium chloride, which absorbs moisture efficiently and effectively. A back pressure regulator 129A receives pressurized air from air dryer 127A and maintains the pressure level in chemical dryer 127A at a predetermined minimal level such as 85 psi, for example, which is desirable for the efficient drying of the compressed air. The back pressure regulator 129A may not be necessary for other types of chemical or mechanical dryers.

Prior to the compressed air from air compressor 10A reaching differential pressure regulator 104A, the compressed air passes moisture separator 113A, heat exchanger 123A, moisture separator 125A and chemical dryer 127A. As a result of the cooling and drying process, the compressed air to differential pressure regulator 104A and abrasive supply 100A has a moisture content less than about 2 grains water per cubic feet of air, and a dewpoint of or below 0° F., which is desirable for the finely divided sodium bicarbonate particles in abrasive supply 100A for conveyance to transport line 117A. Moisture separator 113A removes only condensed (liquid) water prior to the cooling of the compressed air to a temperature of about 80° F. by heat exchanger 123A which condenses most of the water vapor remaining in the compressed air for removal by moisture separator 125A. Remaining water vapor is then removed by chemical dryer 127A.

A pressure controller 140A for pressure regulator 115A, connected to branch line 121A, extends to the dome of pressure regulator 115A and provides a control fluid pressure for example, of 70 psi, for regulator 115A through line 141A. Pressure controller 140A includes a manual control, such as a spring, by which its output may be controlled in pressure, for example at 70 psi. Pressure controller 140A may not be needed for use with other types of pressure regulators 115A.

A pressure sensing line 130A extends between pressure regulator 115A and differential pressure regulator 104A. The output pressure of differential pressure regulator 104A is the mathematical sum of the pressure in sensing line 130A and the bias pressure set by a spring manual control. Accordingly, the pressure in line 102A to abrasive supply 100A is maintained at a predetermined amount above the pressure in transport line 117A.

For illustration of the invention, but not to limit the invention to specific pressures, the fluid pressure in transport line 117A may be maintained at a constant level of 70 psi while the pressure in line 102A to abrasive supply 100A may be maintained automatically at a specified set pressure between about 71 and 75 psi for example. The precise pressure differential may depend on such factors, for example, as the type and size of abrasive material, the size of orifice 200, and the amount of abrasive material desired in the mixture of water and abrasive material discharged from nozzle 23A. If desired to vent abrasive supply 100A, a three way valve 105A may vent line 102A to atmosphere through vent line 131A.

As indicated previously, water pump 21A is pneumatically driven by a suitable pneumatic drive 132A, and a pressure regulator 133A in line 135A connected to branch line 121A controls the pressure to pneumatic drive 132A. If desired, a suitable rust inhibitor may be injected in the water supply at pump 21A. A diesel, gasoline, electric or hydraulic driven pump may also be used in place of the pneumatic driven pump.

Operation of the Embodiment of FIG. 3

In operation, air compressor 10A supplies compressed air at a pressure of about 125 psi through on-off valve 112A and at a rate of about 425 cfm (cubic feet per minute), for example, to line 110A and branch line 121A. Pressure regulator 115A reduces the pressure to about 100 psi for transport line 117A to nozzle 23A. Water is supplied from water reservoir 16A through line 135A to high pressure pump 21A, and high pressure water at a pressure of about 3000 psi is supplied to nozzle 23A through line 22A.

Dry air for abrasive supply 100A is supplied through heat exchanger 123A, water separator 125A, chemical air dryer 127A (if necessary depending on the type of chemical air dryer), and back pressure regulator 129A to differential pressure regulator at a pressure of 125 psi, for example. Differential pressure regulator 104A may be set manually for 1 to 10 psi above the fluid pressure of 100 psi in transport line 117A (100–110 psi total).

The pressure in transport line 117A is sensed continuously by differential pressure regulator 104A through sensing line 130A. Pressure in line 102A is maintained automatically at 1–10 psi above the fluid pressure in transport line 117A even though a pressure change may occur in transport line 117A. Thus, an operator does not have to monitor continuously pressure gauges (not shown) for transport line 117A and air supply line 102A to abrasive supply 100A. Dry gas, that is, air which has been dried, is delivered through line 102A to abrasive supply 100A which contains finely divided bicarbonate of soda particles or other water soluble particles, or any other abrasive such as sand. A mixture of dry air and bicarbonate of soda particles is controlled by on-off valve 119A and metered, by orifice (200) into mixing tee 121A in transport line 117A for entrainment in the compressed air of transport line 117A for delivery to nozzle 23A. Water is mixed at high pressure with the air and bicarbonate of soda particles in nozzle 23A for discharge from the propulsion chamber of nozzle 23A in a high velocity stream against the surface to be cleaned.

The pressures and flow rates mentioned above are merely illustrative of the present invention and are not intended to be limiting. Although dry air or nitrogen has been proposed as the gaseous medium for use in the present invention, other noncombustible dry gases could be used, such as carbon dioxide or helium. A wide variety of fluid sensitive abrasive particles can be used, that could not heretofore be used, because of flow problems encountered. The differential pressure metering system described above is suitable for metering particles from 1 to 400 microns, whether or not they are moisture sensitive.

Since certain changes or modifications can be made in the disclosed embodiments without departing from the inventive concepts involved, it is the aim of the appended claims to cover all such changes and modifications falling within the true spirit and scope of the present invention.

What is claimed is:

1. Apparatus for use in an abrasive blasting system, comprising, hopper means (100A) for containing a quantity of abrasive particles;

conduit means (102A) for supplying a dry gas under pressure to the interior of said hopper means;

transport line means (117A) connected to a source 10A of pressurized air for transporting abrasive in said abrasive blasting system;

an abrasive particle feed line 118A connecting the interior of said hopper means to said transport line means (117A);

first pressure regulating means (115A) disposed in said transport line means (117A) for regulating the pressure of air in said transport line means;

second pressure regulating means (104A) disposed in said conduit means for controlling the pressure of said dry gas as applied to said interior of said hopper means; and said second pressure regulating means (104A) being a differential pressure regulating valve set at a predetermined pressure differential between said first and second pressure regulating means so that the pressure in said hopper means (100A) is maintained automatically at a predetermined pressure level above the pressure in said transport line means (117A) to permit a controlled flow of said abrasive from said hopper means (100A) into said transport line (117A).

2. Apparatus as set forth in claim 1, wherein said dry gas comprises dry air.

3. Apparatus as set forth in claim 2, further comprising:

air supply means for supplying dry air to said second pressure regulating means (104A) for said conduit means (102A), said air supply means including means to cool said air, and means to dry said air after being cooled.

4. Apparatus as set forth in claim 3, wherein said means to dry said air includes water separation means (125A) and chemical drying means (127A) for drying said air after separation of water by said water separation means.

5. Apparatus as set forth in claim 3, wherein said means to cool said air comprises an air to water heat exchanger (123A).

6. Apparatus as set forth in claim 1, wherein a pressure sensing conduit (130A) extends between said second pressure regulating means (104A) and said first pressure regulating means (115A) to provide sensing of the pressure in said transport line means by said first pressure regulating means with said first pressure regulating means including means for manually setting a predetermined pressure above the pressure in said transport line means.

7. Apparatus as set forth in claim 6, wherein said first pressure regulating means (115A) is set at a pressure so that the mathematical sum of the sensing line pressure plus a manually set pressure is between around one (1) and ten (10) psi above the pressure in said transport line means (117A), thereby to maintain the pressure in said hopper above the pressure in said transport line means.

8. Apparatus for use in a water propelled abrasive cleaning system having an air supply, a water supply, and a supply of abrasive particles, said apparatus comprising:

nozzle means having a water inlet and an air and abrasive inlet;

pump and conduit means for providing water under high pressure from said water supply to said nozzle means;

a main transport line from said air supply to said nozzle for conveying a mixture of compressed air and bicarbonate particles to said air and abrasive inlet of said nozzle means;

a first fluid pressure regulator means in said main transport line to control the pressure therein;

container means for the supply of bicarbonate particles to be delivered under pressure to said transport line downstream of said fluid pressure regulator;

a separate pressurized air supply line for said container means to supply pressurized dry air to said container means;

a second fluid pressure regulator means in said air supply line for said container, said second regulator means being in fluid communication with said first regulator means, for maintaining automatically the pressure in said container means at a precise level above the pressure in said transport line to permit a controlled flow of bicarbonate particles into said transport line; and air drying means to dry said air in said air supply line upstream of said second fluid pressure regulator means.

9. Apparatus as set forth in claim 8, wherein a pressure sensing conduit extends between said first fluid pressure regulator means and said second fluid pressure regulator means to provide sensing of the pressure in said transport line by said second fluid pressure regulator means so that the fluid pressure in said separate air line to said container means is maintained at a level higher than the pressure in said transport line to said nozzle means.

10. Apparatus as set forth in claim 9, wherein said second fluid pressure regulator means is a differential pressure regulator and includes means to set said regulator at a predetermined pressure differential between the fluid pressure in said transport line and said separate air supply line to maintain the pressure in said separate air supply line to said container means at a predetermined amount above the pressure in said transport line to said nozzle means.

11. Apparatus as set forth in claim 10, wherein said second pressure regulator means is set at a pressure between around one (1) and ten (10) psi above the pressure in said transport line.

12. Apparatus as set forth in claim 8, wherein air cooling means is provided in said air supply line to cool the air upstream of said air drying means.

13. Apparatus as set forth in claim 12, wherein said air cooling means comprises an air to water heat exchanger.

14. The apparatus of claim 13, wherein water of said heat exchanger is simultaneously said water supply, such that water temperature of said water supply is elevated by said heat exchanger thereby enhancing the cleaning effectiveness of said apparatus.

15. Apparatus as set forth in claim 8, wherein said air drying means comprises a water separation means and chemical drying means for drying said air after removal of moisture by said water separation means.

16. A method of supplying a controlled amount of abrasive particles from a container to an air transport line for conveyance to a nozzle for entrainment with water for discharge against a surface to be cleaned, said method comprising the steps of:

supplying high pressure water to said nozzle;

providing a pressurized air source;

providing pressurized air from said air source to said transport line at a predetermined pressure for conveyance to said nozzle;

providing air drying means to dry air from said pressurized air source;

providing pressurized dry air from said air drying means at a pressure greater than the pressure in said transport line to an air supply line for said container; and providing an abrasive feed line from said container to said transport line upstream of said nozzle for the supply of abrasive to said transport line for conveyance to said nozzle for entraining with high pressure water for discharge against the surface to be cleaned.

17. The method as set forth in claim 16, further including the step of providing pressure regulating means in said air supply line to said container for automatically maintaining the pressure in said air supply line at an amount higher than the air pressure in said transport line.

18. The method as set forth in claim 16 further including the step of cooling the pressurized air for said air supply line to said container.

* * * * *